US006015204A

United States Patent [19]

Ha

[11] Patent Number: 6,015,204

[45] **Date of Patent: *Jan. 18, 2000**

[54] METHOD FOR SENSING CARRIAGE POSITION SEPARATION AND COMPENSATING CARRIAGE POSITION OF AN INKJET PRINTER

[75] Inventor: Jong-ho Ha, Kyungki-do, Rep. of Korea

[73] Assignee: Samsung Electronics Co., Ltd., Rep. of Korea

[ * ] Notice: This patent issued on a continued prosecution application filed under 37 CFR 1.53(d), and is subject to the twenty year patent term provisions of 35 U.S.C. 154(a)(2).

[21] Appl. No.: 08/763,124

[22] Filed: Dec. 10, 1996

[30] Foreign Application Priority Data

Dec. 12, 1995 [KR] Rep. of Korea ..... 95-48519

[51] Int. Cl.[7] ..... B41J 23/00

[52] U.S. Cl. ..... 347/37

[58] Field of Search ..... 347/37; 400/279; 395/105

[56] References Cited

U.S. PATENT DOCUMENTS 4,785,312 11/1988 Toyomura ..... 400/279 X
5,605,407 2/1997 Hama et al. ..... 400/279 X
5,617,122 4/1997 Numata et al. ..... 347/37 X
5,701,145 12/1997 Ninomiya ..... 347/23
5,825,381 10/1998 Choo ..... 347/37

*Primary Examiner*—N. Le
*Assistant Examiner*—Michael Nghiem
*Attorney, Agent, or Firm*—Banner & Witcoff, Ltd.

[57] ABSTRACT

A method for sensing separation of a carriage from a home position and compensating the home position by using a program stored at a microprocessor of an ink jet printer includes a home position separation sensing process which has the steps of: checking whether or not the ink jet printer is in a stop state and the carriage is placed at the home position; checking whether or not the carriage placed at the home position is separated from the position by sensing the state change of a photo sensor; and setting a flag according to the state change of the photo sensor, and a home position separation state compensating process which has the steps of: checking whether or not a flag has been set; if it is checked that the flag has been set, counting time to maintain the present state for a predetermined time; resetting the home position if the counted time exceeds the predetermined time; checking whether or not an ink cartridge is attached to the carriage; if it is checked that the ink cartridge is attached to the carriage, compensating the position of the carriage tocorresponds to the reset home position; and after completion of the compensating step, clearing all related flags.

1 Claim, 5 Drawing Sheets

METHOD FOR SENSING CARRIAGE POSITION SEPARATION AND COMPENSATING CARRIAGE POSITION OF AN INKJET PRINTER

BACKGROUND OF THE INVENTION

1. Field of the Invention

The present invention relates to a method for compensating carriage position of an ink jet printer, and more particularly to a method for sensing compulsory separation of a carriage from a home position in a stop state and compensating the home position by using a software method in an ink jet printer.

2. Discussion of Related Art

An ink jet printer has a carriage mounted on a main frame and moved right and left by a belt which is driven by a belt pulley, a head which is mounted on the carriage, moved together with the carriage and has a nozzle for discharging ink and a home position unit for cleaning the head in response to a cleaning signal at a predetermined cycle or capping the head.

In the printer of this type, if a print signal is applied, the carriage mounted on the main frame is moved right and left together with the head mounted thereon, and the nozzle of the head discharges ink onto the feeding paper, performing a printing.

The home position unit serves to clean the nozzle of the head to prevent the clogging thereof and to cap the nozzle while not printing after the printing operation to prevent the ink at the nozzle from being dried.

Whether or not the carriage is separated from home position is checked in the state when the carriage is positioned at the home position after printing operation. The position separation sensing method depends on the signal generated by a photo sensor and a code bar not on the driving signal provided by a microcomputer. FIG. 1 is a circuit diagram showing a conventional photo sensor unit, and FIG. 2 is a diagram showing a code bar generating an on/off signal.

Referring to FIG. 1, photo sensors A and B provide pulse waves which have a phase difference of 90 deg func{C} to an X axis channel and an Y axis channel. Capacitors C1 and C2 respectively connected to the photo sensors A and B serve to isolate signal noise generated at each photo sensor.

In this case, the phase difference of 90 deg func{C} is possible since the code bar 20 in FIG. 2 generates an on/off signal by the separated distance of the photo sensors A and B.

Referring to FIG. 2, the code bar 20 has a plurality of holes (21*a*, 21*b*, 21*c* . . .) and generates the on/off signal according to whether or not the light from the photo sensors A and B passes through the holes in the code bar 20.

If there occurs a signal change in the X and Y axis channels, the count value storing a carriage position value is increased or decreased by this change. Even though a user moves a motor by hand in a stop state when a driving signal is not generated after application of the power, the pulse signal is generated by the photo sensors A and B and the code bar 20, and thus the position count value of the motor is changed. Therefore, it is possible to sense whether or not the motor is compulsorily moved.

That is, with the circuit construction and code bar as described above, if the on/off pulse signal is not sensed at the X and Y axis channels, it is determined that the carriage of the printer is in a stop state. On the contrary, if the on/off pulse is sensed at the X and Y axis channels in the stop state, it is determined that the carriage is abnormally moved and thus a position compensating operation is performed.

The method for sensing carriage position separation as described above requires expensive components, such as two photo sensors and a code bar, etc, causing an increase of the manufacturing cost.

SUMMARY OF THE INVENTION

Accordingly, the present invention is directed to a method for sensing carriage position separation and compensating carriage position that substantially obviates one or more of the problems due to limitations and disadvantages of the related art.

An object of the present invention is to provide a method for sensing carriage position separation and compensating carriage position by a photo sensor and an actuator mounted on the carriage, by using a program stored at a microprocessor.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, a method for sensing separation of a carriage from a home position and compensating the home position by using a program stored at a microprocessor of an ink jet printer includes a home position separation sensing process which has the steps of: checking whether or not the ink jet printer is in a stop state and the carriage is placed at the home position; checking whether or not the carriage placed at the home position is separated from the position by sensing the state change of a photo sensor; and setting a flag according to the state change of the photo sensor, and a home position separation state compensating process which has the steps of: checking whether or not a flag has been set; if it is checked that the flag has been set, counting time to maintain the present state for a predetermined time; resetting the home position if the counted time exceeds the predetermined time; checking whether or not an ink cartridge is attached to the carriage; if it is checked that the ink cartridge is attached to the carriage, compensating the position of the carriage to correspond to the reset home position; and after completion of the compensating step, clearing all related flags.

It is to be understood that both the foregoing general description and the following detailed description are exemplary and explanatory and are intended to provide further explanation of the invention as claimed.

BRIEF DESCRIPTION OF THE ATTACHED DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF PREFERRED EMBODIMENT

Reference will now be made in detail to the preferred embodiments of the present invention, examples of which are illustrated in the accompanying drawings.

Figure 1:
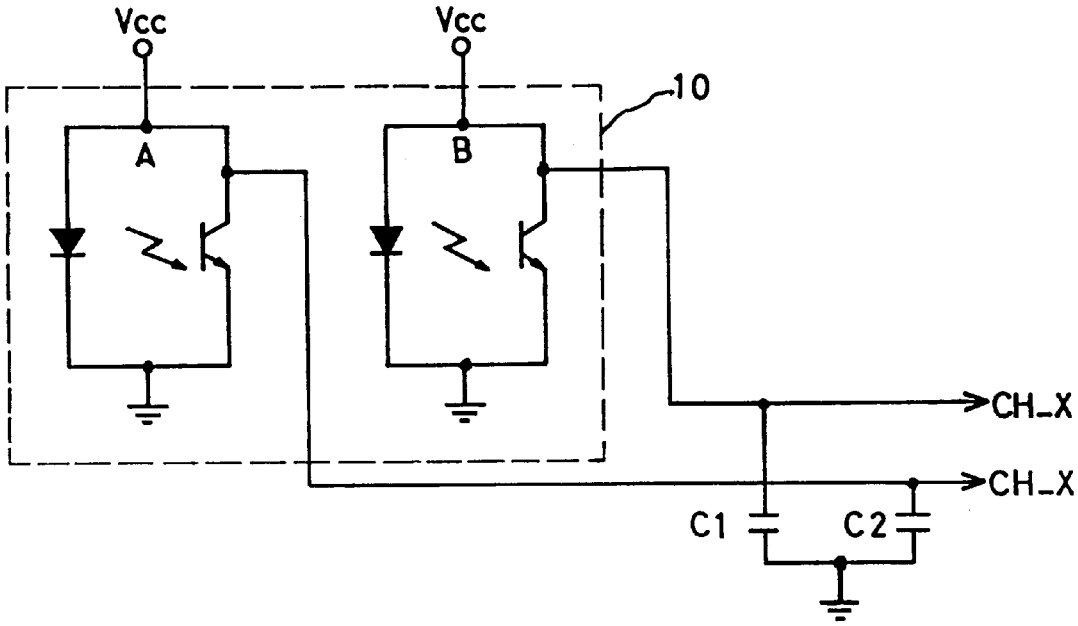
FIG. 1 PRIOR ART
FIG. 1 is a circuit diagram showing a conventional photosensor unit.
Figure 2:
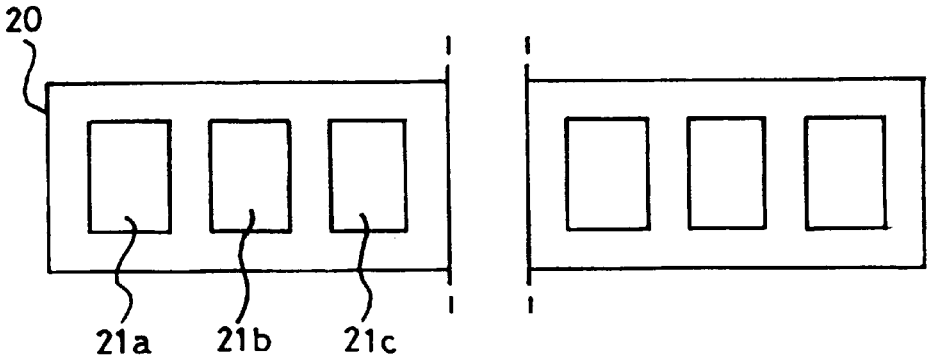
FIG. 2 PRIOR ART
FIG. 2 is a diagram showing a code bar for generating an on/off signal.
Figure 3:
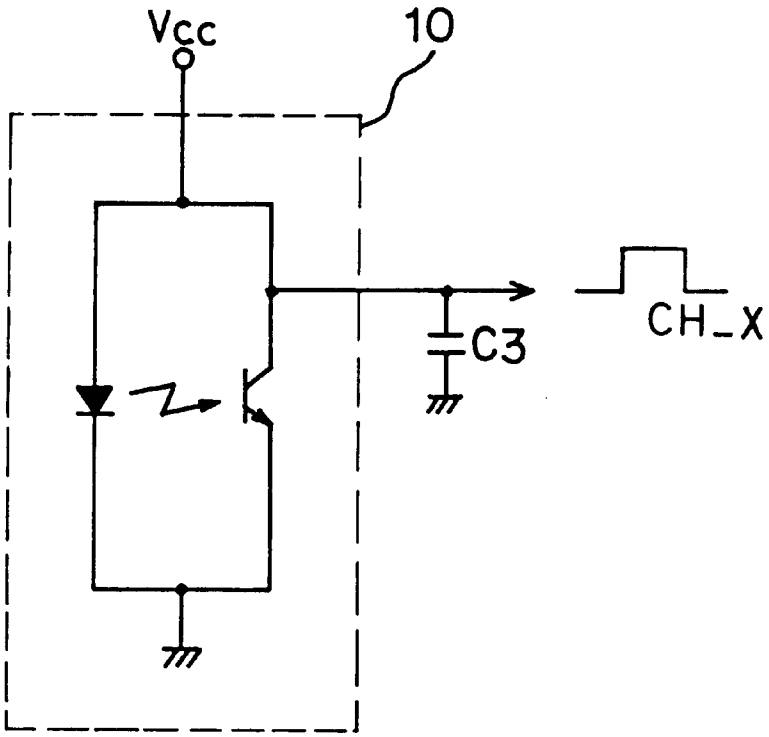
FIG. 3 is a circuit diagram showing a photo sensor unit according to the present invention.

FIG. 3 is a circuit diagram showing a photo sensor unit according to the present invention. As shown in the figure, the photo sensor unit has only one photo sensor 10 for generating a pulse wave, while the conventional photo sensor unit of FIG. 1 has two photo sensors.

A capacitor C3 connected to the photo sensor 10 serves to isolate the signal noise which may affect the X axis channel.

Figure 4:
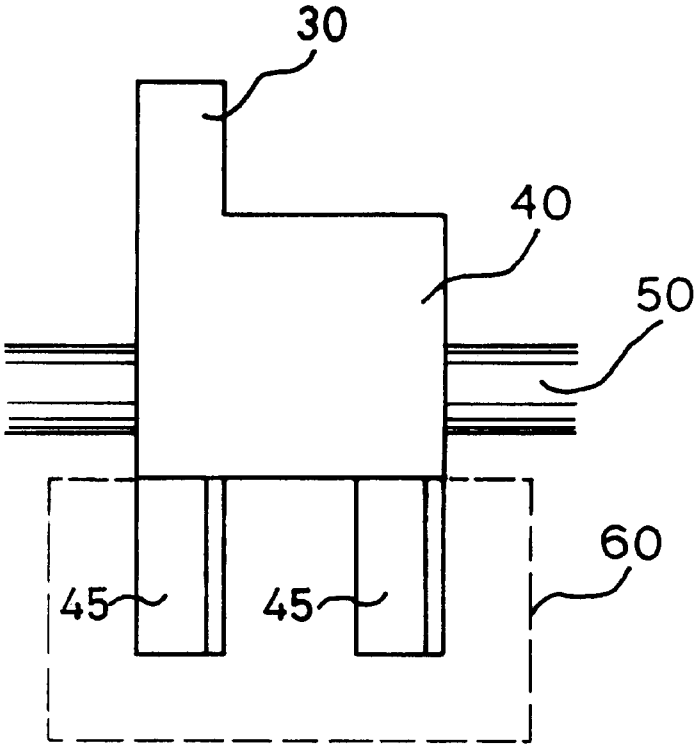
FIG. 4 is a plan view showing a carriage having an actuator mounted thereon.

FIG. 4 shows a carriage with an actuator. FIG. 4 has a carriage body 40 which is moved right and left by a carriage shaft 50, an actuator 30 mounted on the rear of the carriage body 40, and an ink cartridge fixing unit 45 placed at the front of the carriage body 40, for housing an ink cartridge 60 which performs printing on a paper according to a printing command.

The present invention is performed by the photo sensor of FIG. 3 and the actuator mounted on the carriage body of FIG. 4.

The operation of the present invention according to the position of the photo sensor and actuator will be discussed with reference to FIGS. 5 and 6.

Figure 5:
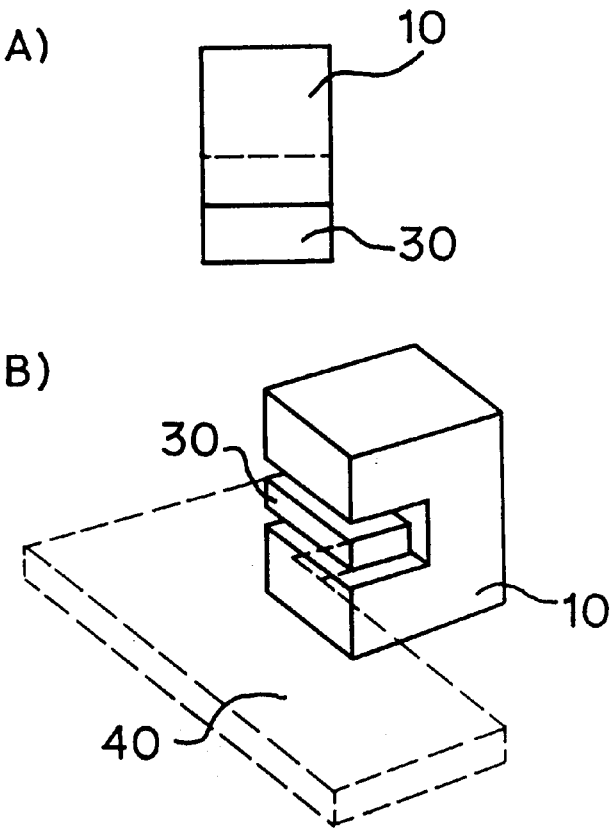
FIG. 5 is a diagram showing an off state of the photo sensor.

FIG. 5 shows the off state of the photo sensor. FIG. 5A shows the state when the actuator 30 mounted on the rear of the carriage body 40 is inserted between the luminous element and light receiving element of the photo sensor 10, and FIG. 5B is a perspective view of FIG. 5A.

In this case, the light emitted from the luminous element of the photo sensor 10 is isolated by the actuator 30 and thus is not transmitted to the light receiving element of the photo sensor 10. Thereby, the photo sensor 10 senses that the carriage is placed at the home position.

Figure 6:
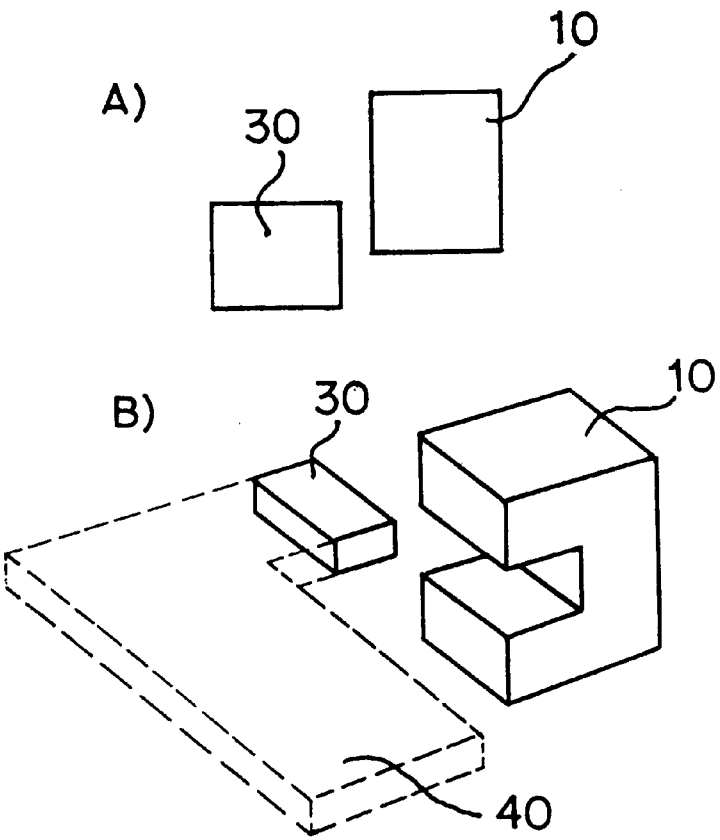
FIG. 6 is a diagram showing an on state of the photo sensor.

FIG. 6 is a diagram showing the on state of the photo-sensor. FIG. 6A shows the state when the actuator 30 is separated from the photo sensor 10, and FIG. 6B is a perspective view of FIG. 6A.

In this case, the light emitted from the luminous element of the photo sensor 10 is supplied to the light receiving element of the photo sensor 10, and thereby the photo sensor 10 senses that the carriage is separated from the home position.

The process of sensing the carriage position separation and compensating the carriage position will be discussed with reference to the flow charts of FIGS. 7 and 8.

Figure 7:
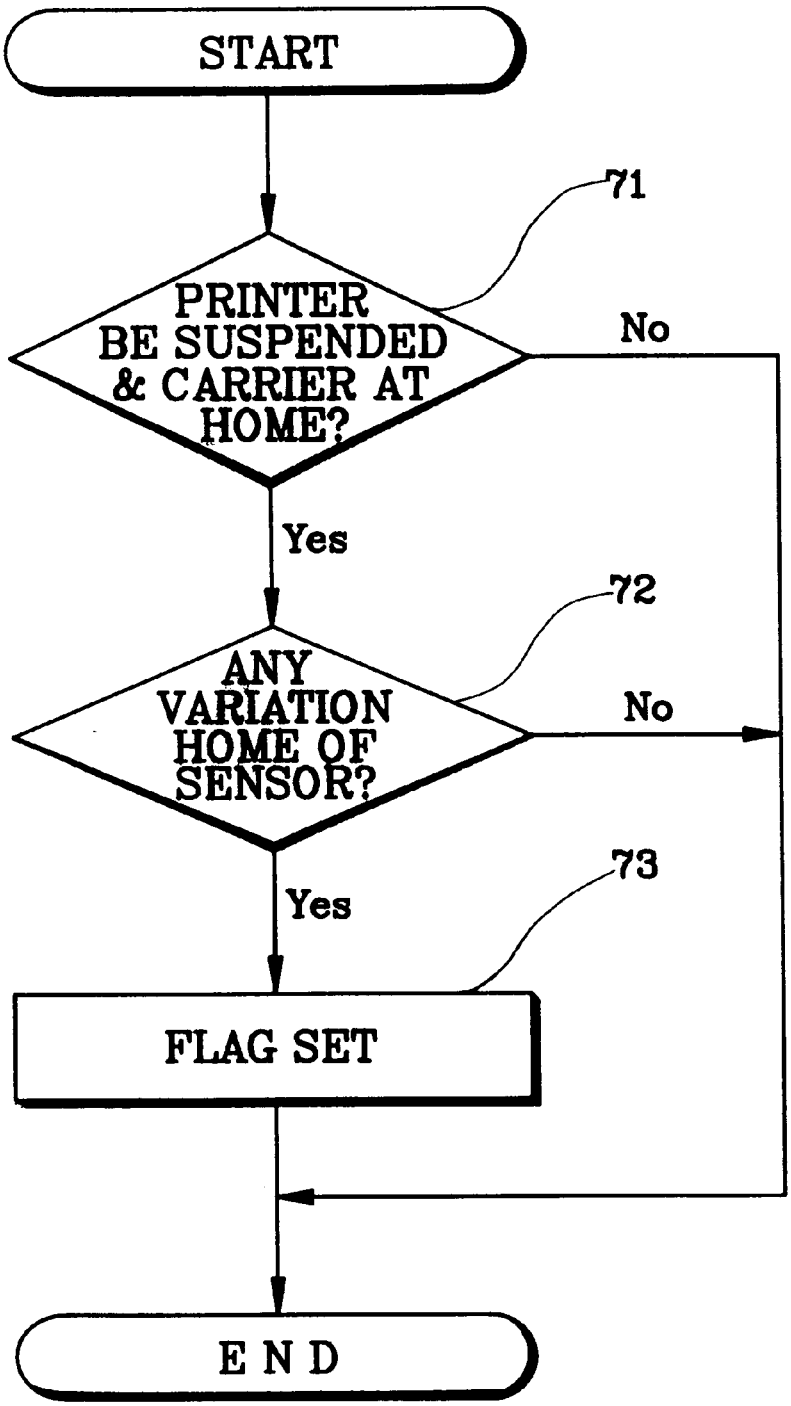
FIG. 7 is a flow chart showing a carriage position separation sensing method according to the present invention.
Figure 8:
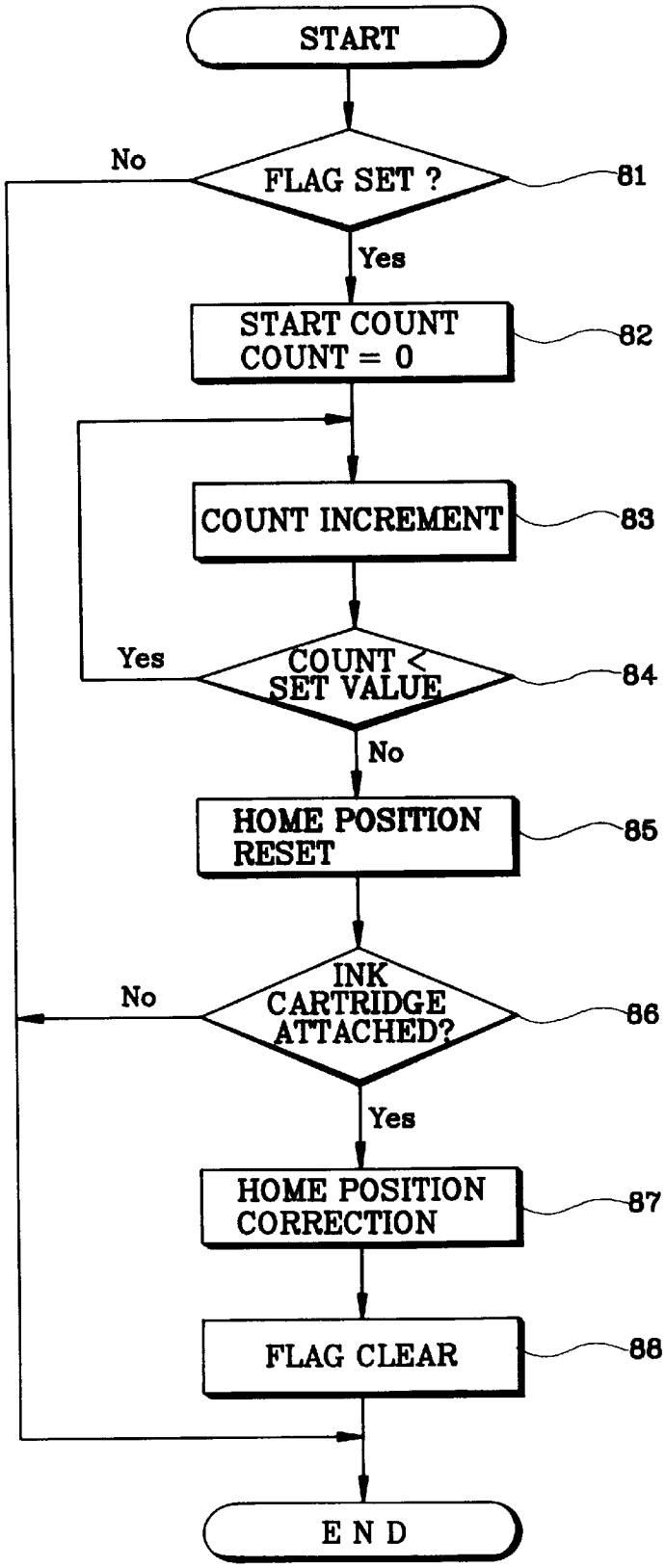
FIG. 8 is a flow chart showing a carriage position compensating method according to the present invention.

The program flows shown in FIGS. 7 and 8 are different interrupt. The term "interrupt" means that a microprocessor is compulsorily moved to a specific address while it performs a program of a predetermined address. If there occurs an interrupt, the microprocessor stops performing the program of a predetermined address, stores important data therein to a main memory device and then moves control to the program of a specific address. There are interrupts that occur due to the malfunction of the program or device, a periodical start interrupt and a completion informing interrupt of an I/O device, etc.

FIG. 7 is a flow chart showing a method for sensing the carriage position separation.

In step 71, it is checked whether the printer is in a stop state and the carriage is placed at home position. If it is checked that the printer is not in a stop state or the carriage is not placed at home position, this program ends.

If it is checked in step 71 that the printer is in a stop state and the carriage is placed at home position, whether or not the carriage is separated from the home position, (i.e., whether or not the photo sensor is turned on by the movement of the actuator mounted on the carriage) is sensed by the photo sensor in step 72. If there occurs no change in the state of the photo sensor, this program ends. On the contrary, if there occurs any change in the state of the photo sensor, a flag is set in step 73 and then this program ends.

FIG. 8 is a flow chart showing a method for compensating the carriage position.

In step 81, it is checked whether or not the flag has been set. If not in step 81, this program ends. However, if it is checked that the flag has been set, a timing counting is initialized in step 82.

In step 83, the count value is increased and it is then checked in step 84 whether or not a predetermined value is greater than the increased counting value. If a predetermined value is greater than the counting value, this program returns to step 83, and if not, this program advances to step 85.

These timing counting steps (step 82 to step 84) are for temporarily maintaining the position separation state of the carriage. If the compensating procedure is performed immediately after sensing the separation, there may occur a breakout by a user or other obstacles. With this reason, the position separation state is maintained for a predetermined time.

If a predetermined value is not greater than the counting value, this means that the carriage is compulsorily separated from the home position. Thus, the home position is reset in step 85.

In step 86, it is checked whether or not an ink cartridge is attached to the carriage. This checking is needed since the above compulsory separation from its position is for exchanging the head. If it is checked that the ink cartridge is not attached to the carriage, this program ends. If it is checked that the ink cartridge is attached to the carriage, the home position is compensated in step 87. Thereafter, all related flags are cleared in step 88.

The method for sensing the separation of the carriage from the home position and compensating the home position according to the present invention can sense the carriage position separation without driving a step motor in a stop state of the ink jet printer and can prevent the damage of the head of the ink cartridge when the carriage is separated from the position.

In addition, this method of the present invention requires less components as compared with the conventional method requiring photo sensors, code bar and other components, enabling reduction of the manufacturing time and manufacturing cost and simple manufacturing process.

It will be apparent to those skilled in the art that various modifications and variations can be made in the manufacturing method of the silicon minute device of the present invention without departing from the spirit or scope of the invention. Thus, it is intended that the present invention cover the modifications and variations of this invention provided they come within the scope of the appended claims and their equivalents.

What is claimed is:

1. A method for sensing a separation of a carriage of a printer from a home position and moving the carriage, the method comprising steps of sensing and compensating, wherein:

the step of sensing includes a substep of checking whether the printer is in a stop state and whether a value storing the carriage position indicates the home position;

the step of sensing further includes a substep of determining whether a photo sensor indicates that the carriage is in the home position;

the step of sensing further includes a substep of setting a flag when (1) the substep of checking indicates that the printer is in the stop state and the value storing the carriage position indicates the home position, and (2) the substep of determining indicates that the carriage is not in the home position;

the step of compensating includes a substep of checking whether the flag has been set;

the step of compensating further includes a substep of maintaining a separation state of the carriage from the home position for a predetermined time when the flag has been set;

the step of compensating further includes a substep of resetting the value storing the carriage position after the predetermined time;

the step of compensating further includes a substep of testing whether an ink cartridge is attached to the carriage;

the step of compensating further includes a substep of moving the carriage to the home position when the ink cartridge is attached; and the step of compensating further includes a substep of clearing the flag.

* * * * *